US005147102A

United States Patent [19]

Dyer, Jr.

[11] Patent Number: 5,147,102

[45] Date of Patent: Sep. 15, 1992

[54] REFUSE CARRIER

[76] Inventor: Richard H. Dyer, Jr., Black Rock Farm, Black Rock Rd., Watertown, Conn. 06795

[21] Appl. No.: 653,306

[22] Filed: Feb. 11, 1991

[51] Int. Cl.[5] ..... B65D 75/00; B65F 1/12

[52] U.S. Cl. ..... 294/152; 294/1.1

[58] Field of Search ..... 294/1.1, 152, 156; 383/4; 15/257.1; 56/329

[56] References Cited

U.S. PATENT DOCUMENTS

| | | | |
|---|---|---|---|
| 2,766,797 | 10/1956 | Cowen | 294/1.1 X |
| 3,739,561 | 6/1973 | Boudeman | 56/329 |
| 3,779,156 | 12/1973 | Race | 294/152 X |
| 4,434,829 | 3/1984 | Barnard | 294/1.1 X |
| 4,519,183 | 5/1985 | Parody | 294/1.1 X |
| 4,561,480 | 12/1985 | Underwood et al. | 294/1.1 X |
| 4,602,664 | 7/1986 | Hullen | 294/1.1 X |
| 4,606,070 | 8/1986 | Schacter | 383/4 |
| 4,693,504 | 9/1987 | Baker | 294/1.1 |
| 4,738,477 | 4/1988 | Grossmayer | 294/1.1 |

*Primary Examiner*—Margaret A. Focarino
*Assistant Examiner*—Dean J. Kramer

[57] ABSTRACT

A flexible carrier has a trapezoidal shape with a smooth and slippery surface. Angled side edges are notched out and doubled back to form tunnels with slippery insides. Rigid elongate elements are disposed in the tunnels and, when the carrier is loaded, are graspable by a single hand through the notches, the elements readily rotating to be comfortably gathered together as the hand closes. The notches are ample to permit shifting of the hand lengthwise of the elements into better alignment over the center of gravity of the loaded carrier.

4 Claims, 1 Drawing Sheet

REFUSE CARRIER

BACKGROUND OF THE INVENTION

1. Field of the Invention

This invention relates to a flexible carrier most usually for a load of refuse such as leaves and grass clippings. More specifically, this invention is a carrier that can be readily brought closed and carried by a single hand.

2. Description of Related Art including Information Disclosed under §§1.97 to 1.99

The prior art is replete with examples of flexible carriers of the type having a sheet of flexible material having rigid support elements along opposite edges whereby the user can load refuse such as leaves or grass clippings onto the sheet and then bring together the two support elements to shape the refuse into a package and hold it closed and carry it to the point of disposal.

A pertinent example of such a carrier is disclosed in U.S. Pat. No. 4,693,504 dated Sep. 15, 1987 to Anna M. Baker wherein the sheet is trapezoidal in shape and the rigid elements are secured to the two angled opposite sides. Other examples of carriers of the general type are the following U.S. patents:

| | | |
|---|---|---|
| 1,222,973 | April 17, 1917 | L. W. Morter |
| 2,397,433 | March 26, 1946 | C. E. Reeves |
| 2,564,907 | August 21, 1951 | W. H. Krummel, Jr. |
| 4,209,116 | June 24, 1980 | Charles D. Hendricks |
| 4,434,829 | March 6, 1984 | Robert L. Barnard |
| 4,519,183 | May 28, 1985 | Ross Parody |
| 4,950,014 | August 21, 1990 | Gregory M. Smith |

A shortcoming of the prior art is that no simple structure such as disclosed in Baker may be readily closed and carried by a single hand. The simple devices require a two-hand grip and are awkward and uncomfortable to use.

SUMMARY OF THE INVENTION

The present invention in such a carrier formed from a trapezoidal sheet of fabric and having a pair of rigid elongate support elements on the angled sides is the improvement wherein the sheet has a smooth and slippery surface. The angled side edges are notched intermediate their ends and are doubled-back and heat-sealed to form elongate tunnels with slippery insides. The elongate support elements are wooden dowels freely disposed in and along the tunnels and are graspable through the notches. The slippery tunnels are ample in width so that the dowels are readily rotated about their longitudinal axes in the tunnels to provide easy and comfortable gripping as the dowels are drawn together by a single hand through the notches to close the carrier.

BRIEF DESCRIPTION OF THE DRAWINGS

Other features and objects of the invention will be apparent from the following description and the drawings, all of which show a non-limiting embodiment of the invention. In the drawings.

DESCRIPTION OF THE PREFERRED EMBODIMENT

Figure 1:
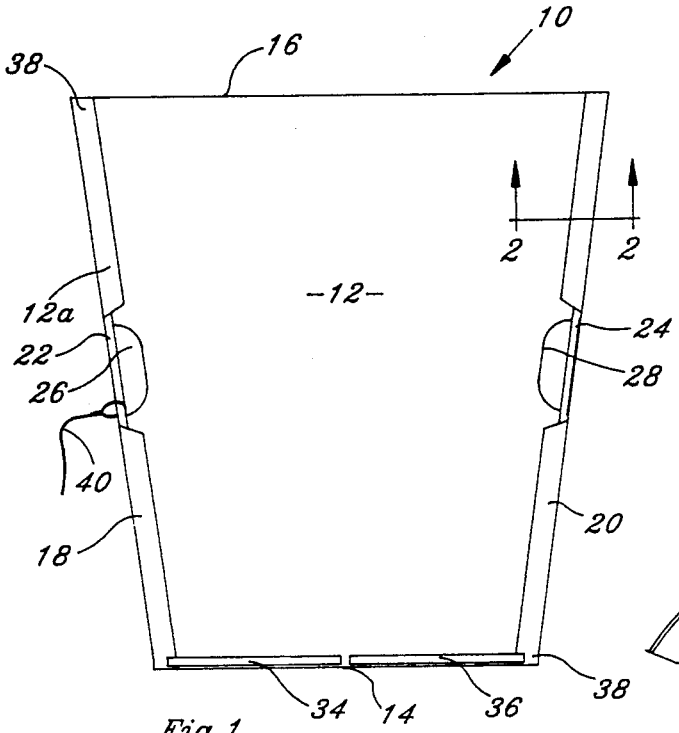
FIG. 1 is a top plan view of a carrier embodying the invention laid out flat as it would be prior to use.

A carrier embodying the invention is generally designated 10 in FIG. 1. It comprises a trapezoidal-shaped sheet 12 which is preferably of woven, or at least intersecting, strands of polyethylene embedded in a polyethylene layer. Alternatively, the material may have a coating of polyethylene on its upper surface as shown in sheet 12 so that the surface which engages the debris is a smooth and slippery side of the sheet. Other fabric having similar smooth and slippery surfaces are contemplated such as polyvinyl chloride, or a woven polyester coated with PVC.

As shown, the front edge 14 is the shorter edge and it is parallel to a longer back edge 16. There are connecting side edges 18 and 20 and a pair of elongate support elements, 22 and 24, which are secured along the edges 18 and 20 respectively as will be described.

The side edges 18 and 20 are notched out as at 26 and 28 intermediate their ends.

Figure 2:
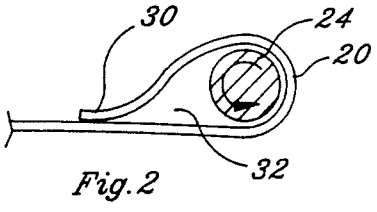
FIG. 2 is an enlarged fragmentary sectional view taken on the line 2—2 of FIG. 1.

The side edges 18, 20 of the material are raised and doubled back (FIG. 2) and heat-sealed or stitched as at 30 to form elongate tunnels 32 into which the side elements 24 are loosely installed. The elements 22, 24 are preferably wooden dowels. In their midsections the dowels are exposed through the notches as shown. The exposed sections, of course, become handles.

Narrow strips of male and female Velcro 34 and 36 respectively are secured to the flexible sheet adjacent the shorter front edge 14.

With the slippery side facing up, as shown in FIG. 1 on the sheet 12, it will be understood that the inside surfaces of the tunnels 32 are slippery and, because there is ample room for the elements 22 and 24, the elements are free to rotate within the tunnels. At each end of the tunnels 32 the material is heat-sealed, or in the case of PVC, stitched as at 38 to trap the side elements from moving endwise out of their respective tunnels.

Figure 4:
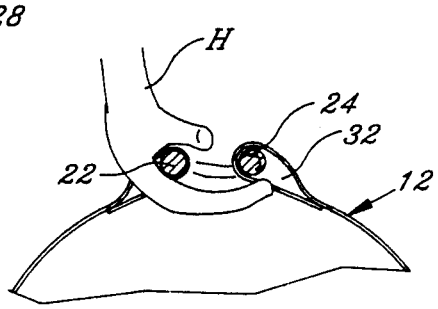
FIG. 4 is an enlarged fragmentary view of the top of the carrier and showing a single hand drawing the side elements together.
Figure 3:
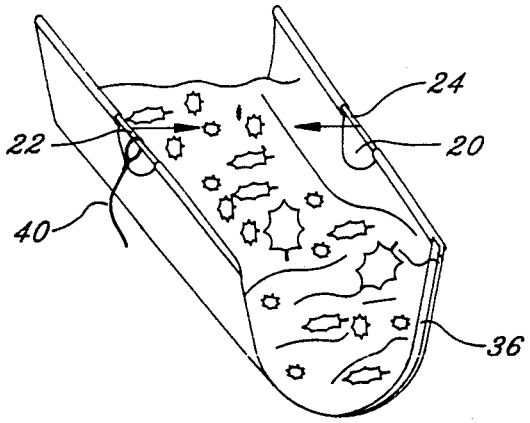
FIG. 3 is a perspective view shown loaded and ready to have its side elements drawn together to close the carrier.
Figure 5:
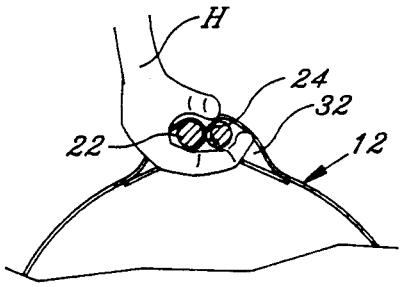
FIG. 5 is a view similar to FIG. 4 but subsequent wherein the elements have been drawn together by the single hand to make the load comfortable to carry.

In use, the carrier may be disposed flat on the ground with the slippery side up (FIG. 1). Debris is then raked or otherwise placed on the top of the slippery surface. The element 22, may be grasped through the notch 26 by a singe hand and brought over to the element 24 (FIG. 4). The tips of the fingers of the hand hooking element 24 may then be brought upward gathering in the element 24, and, as the hand is closed, the element 24 easily rotates (FIG. 5) until the elements are in side-by-side relation and the hand clenched in a fist about both of them. This "closes" the carrier.

Figure 6:
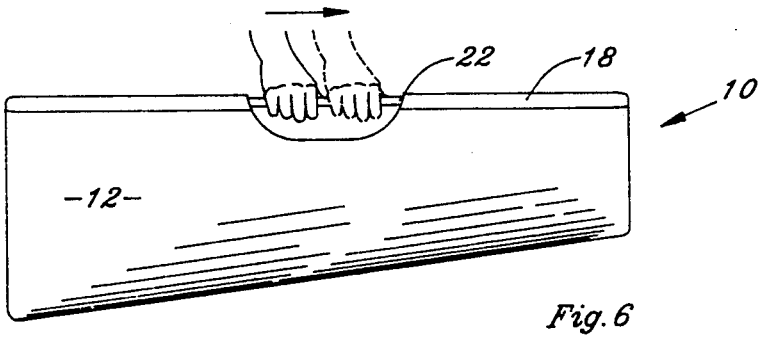
FIG. 6 is a side view showing the loaded carrier being supported by a single hand and showing in dotted lines the hand shifted to a position along the side elements to align with the proper center of gravity of the loaded carrier so that the carrier may be comfortably transported by a singe hand.

The initial grasp by the hand H (FIG. 6) may prove to be to one side or the other out of alignment with respect to the center of gravity of the loaded carrier. To balance the carrier, the hand may be shifted (FIG. 6, dotted lines) to where it is over the center of gravity. This will make the transporting of the loaded carrier more comfortable and avoid tipping.

It is sometimes desired to store the carrier in loaded condition or to keep the carrier "closed" for a moment while the user tends to other matters. For this purpose, a short line 40 of cord is provided. It is preferably looped about one of the elements 22 and ferrelled or tied into a loop with the "tail" available to be wrapped around the two side-by-side elements 22, 24 and knotted to keep them from separating.

In some cases it may be desirable to close completely the smaller end, and for this purpose the sides of the smaller end may be pinched together so that the Velcro strips 34 and 36 engage and hold together releasably.

I have thus developed an improvement on the carriers of the general type shown in the prior art. The improvement involves the use of readily rotatable side elements in the form of wooden dowels 22 and 24 which are entrapped in the slippery tunnels 32. Because the elements are readily rotatable, the carrier is easy to pick up and carry with a single hand. Also, the provision of the enlarged notches 26 and 28 make possible the longitudinal shifting of a single hand to a point directly above the center of gravity of the loaded carrier.

Having thus described the invention in its preferred form, it should be understood that the invention is not so limited but is usable in many modifications and variations. Thus the invention may be thought of as being defined by the following claim language including reasonable expansions of the exclusionary right through the doctrine of equivalents.

What is claimed is:

1. In a flexible carrier for embracing and transporting a shapeable load of refuse or the like comprising:

a) a trapezoidal sheet of fabric defined by a shorter front edge, a longer back edge parallel to the front edge, and connecting side edges; and b) a pair of rigid elongated support elements coextensive with the side edges respectively and secured along the side edges;

wherein the fabric has a smooth and slippery surface, the fabric having notches formed therein in the middle of the side edges, the side edges being double-back and the fabric secured against itself to form elongated tunnels, and the elongate support elements are rotatable members freely disposed in and along the tunnels, the tunnels being ample in width so that when the carrier is full of refuse the members are readily rotated about their longitudinal axes in the slippery tunnels respectively as they are drawn together through notches to provide a means to support the load suspended below the members during transport.

2. A flexible carrier as claimed in claim 1 wherein the fabric is plastic and is secured against itself by heat-sealing and also heat-sealed together at the ends of the tunnels to entrap the dowels.

3. A flexible carrier as claimed in claim 2 wherein the fabric is of polyethylene strands in a layer of polyethylene.

4. A flexible carrier as claimed in claim 1 wherein one of the members in the area of the notch is encircled with a cord having a free end which may be tied around the other member in its notch to hold the two members together with a load within the carrier.

* * * * *